US010247033B2

(12) United States Patent
Appel et al.

(10) Patent No.: US 10,247,033 B2
(45) Date of Patent: Apr. 2, 2019

(54) METHOD AND DEVICE FOR CLEANING A JET ENGINE

(71) Applicant: Lufthansa Technik AG, Hamburg (DE)

(72) Inventors: Holger Appel, Offenbach (DE); Klaus Braeutigam, Moemlingen (DE)

(73) Assignee: LUFTHANSA TECHNIK AG, Hamburg (DE)

( * ) Notice: Subject to any disclaimer, the term of this patent is extended or adjusted under 35 U.S.C. 154(b) by 0 days.

(21) Appl. No.: 15/399,763

(22) Filed: Jan. 6, 2017

(65) Prior Publication Data

US 2017/0114663 A1 Apr. 27, 2017

Related U.S. Application Data

(62) Division of application No. 15/100,344, filed as application No. PCT/EP2014/075981 on Nov. 28, 2014.

(30) Foreign Application Priority Data

Nov. 29, 2013 (DE) ..... 10 2013 224 639

(51) Int. Cl.

| | |
|---|---|
| ***F01D 25/00*** | (2006.01) |
| ***B24C 1/00*** | (2006.01) |
| ***B24C 5/04*** | (2006.01) |
| ***B08B 5/02*** | (2006.01) |
| ***F04D 29/70*** | (2006.01) |

(52) U.S. Cl.
CPC ..... *F01D 25/002* (2013.01); *B08B 5/02* (2013.01); *B24C 1/003* (2013.01); *B24C 5/04* (2013.01); *F04D 29/701* (2013.01); *F05D 2220/323* (2013.01)

(58) Field of Classification Search
None
See application file for complete search history.

(56) References Cited

U.S. PATENT DOCUMENTS

| | | | | |
|---|---|---|---|---|
| 3,981,329 | A * | 9/1976 | Wohlwend | F16L 39/00 137/615 |
| 4,065,322 | A | 12/1977 | Langford | |
| 2002/0086616 | A1 | 7/2002 | Tomlinson | |
| 2006/0048796 | A1 | 3/2006 | Asplund et al. | |
| 2008/0087301 | A1* | 4/2008 | Lee | B08B 3/02 134/18 |
| 2010/0000572 | A1 | 1/2010 | Giljohann et al. | |

(Continued)

FOREIGN PATENT DOCUMENTS

| | | | |
|---|---|---|---|
| DE | 2707316 | A1 | 8/1977 |
| DE | 102008019892 | A1 | 10/2009 |

(Continued)

*Primary Examiner* — Nicole Blan
(74) *Attorney, Agent, or Firm* — Leydig, Voit & Mayer, Ltd.

(57) ABSTRACT

A nozzle installation includes at least one nozzle configured for introducing cleaning media containing solids into a jet engine, and for a rotationally fixed connection to a shaft of a turbofan of a jet engine. The at least one nozzle has a swivel coupling to which a line connection is connectable. A flexible hose forms a connection of a nozzle-side outlet of the swivel coupling to an inlet of the at least one nozzle.

15 Claims, 2 Drawing Sheets

(56) References Cited

U.S. PATENT DOCUMENTS

| | | | |
|---|---|---|---|
| 2010/0200023 | A1 | 8/2010 | Giljohann et al. |
| 2013/0174869 | A1 | 7/2013 | Roesing et al. |

FOREIGN PATENT DOCUMENTS

| | | | |
|---|---|---|---|
| DE | 102008047493 | A1 | 4/2010 |
| DE | 102010020619 | A1 | 2/2011 |
| DE | 102011004923 | A1 | 9/2012 |
| DE | 102011086496 | A1 | 3/2013 |
| WO | WO 2005120953 | A1 | 12/2005 |
| WO | WO 2009132847 | A1 | 11/2009 |
| WO | WO 2012025090 | A2 | 3/2012 |
| WO | WO 2012123098 | A1 | 9/2012 |

* cited by examiner

METHOD AND DEVICE FOR CLEANING A JET ENGINE

CROSS REFERENCE TO RELATED APPLICATIONS

This application is a divisional application of U.S. application Ser. No. 15/100,344 filed on May 31, 2016 which is a U.S. National Phase application under 35 U.S.C. § 371 of International Application No. PCT/EP2014/075981, filed on Nov. 28, 2014, and claims benefit to German Patent Application No. DE 10 2013 224 639.0, filed Nov. 29, 2013. The international application was published in German on Jun. 4, 2015, as WO 2015/079032 A1 under PCT Article 21(2).

FIELD

The invention relates to a method, to a device, and to an assembly for cleaning an aircraft jet engine.

BACKGROUND

Aircraft jet engines include one or a plurality of compressor stages, a combustion chamber, and one or a plurality of turbine stages. The hot exhaust gases emanating from the combustion chamber release part of their thermal and mechanical energy in the turbine stages, said energy being utilized for driving the compressor stages. The majority of jet engines for commercial aircraft today have a so-called turbofan which is disposed upstream of the compressor stages and typically has a diameter which is significantly larger than that of the compressor stages. The turbofan is likewise driven by the turbine stages and allows a significant part of the total air volume which perfuses the jet engine to flow past the compressor stages, the combustion chamber, and the turbine stages, as a so-called bypass flow. By way of such a bypass flow the efficiency of an engine may be significantly increased, moreover allowing for improved noise insulation of the engine.

Contamination of an aircraft jet engine may lead to reduced efficiency, resulting in increased fuel consumption and thus to increased environmental burden. Contamination may be caused, for example, by insects, dust, salt spray, or other types of environmental contamination. Parts of the engine may be contaminated by combustion residues from the combustion chamber. These types of contamination form a layer on those parts of an aircraft engine that are perfused by air, compromising the surface finish. The thermodynamic efficiency of the engine is thus compromised. Here, particular mention should be made of the blades in the compressor stages, the contamination of which blades has a significant effect on the efficiency of the entire engine.

In order for contamination to be removed it is known for an engine to be cleaned using a cleaning fluid, typically hot water. An assembly in which a plurality of cleaning nozzles are disposed upstream of the turbofan, or of the compressor stages, respectively, is known from WO 2005/120953. The cleaning fluid is then sprayed into the engine. Here, the engine may be rotated in the so-called dry cranking mode, that is to say that the blades of the engine are rotated without kerosene being combusted in the combustion chamber. Contamination is to be washed off the surfaces of the engine components by way of the cleaning fluid which is introduced into the engine.

As an alternative to the use of water as a cleaning medium, the use of carbon dust is known. Here, the carbon dust, like the water, is introduced into the engine through nozzles, removing contamination from surfaces by virtue of abrasive effects. However, the surfaces of the engine components are also affected by the carbon dust, which is why a cleaning medium such as carbon dust is not suitable for regular cleaning of aircraft engines. Moreover, when cleaning using carbon dust, undesirable remnants of the cleaning material remain in the engine. WO 2009/132847 A1 discloses a device and a method for cleaning jet engines, using solid carbon dioxide as a cleaning medium.

SUMMARY

In an embodiment, the present invention provides a nozzle installation including at least one nozzle configured for introducing cleaning media containing solids into a jet engine, and for a rotationally fixed connection to a shaft of a turbofan of a jet engine. The at least one nozzle has a swivel coupling to which a line connection is connectable. A flexible hose forms a connection of a nozzle-side outlet of the swivel coupling to an inlet of the at least one nozzle.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
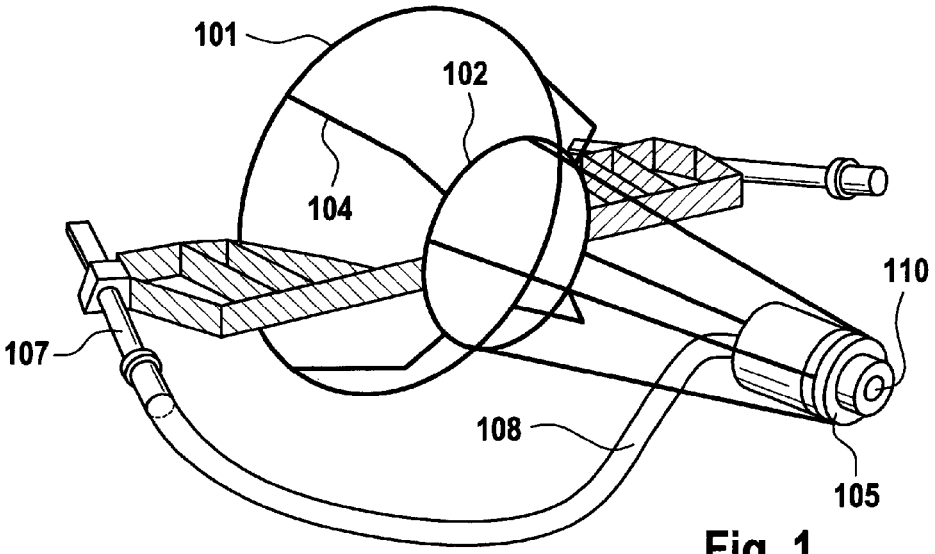
FIG. 1 shows a first view of a nozzle installation according to an embodiment of the invention.

Embodiments of the invention provide methods, devices, and assemblies which enable improved cleaning of aircraft engines.

An embodiment of the invention provides a method for cleaning a jet engine, using a cleaning medium which contains solids. The solids by means of a carrier gas and by way of at least one nozzle are introduced into the engine. According to the embodiment of the invention, the cleaning medium thus comprises at least one carrier gas and solids, preferably exclusively a carrier gas and solids. A carrier gas is a medium which at the application temperature is gaseous; compressed air may preferably be used. The solids may be solids which at the application temperature are stable, such as, for example, plastics beads, glass beads, or carbon dust. However, thermolabile solids, such as, for example, solid carbon dioxide and/or ice (water ice) are preferably used.

Effective cleaning, in particular of the compressor or impeller of an engine, is possible by the claimed method parameters. According to an embodiment of the invention, the cleaning medium follows the flow in the impeller and achieves a cleaning effect in all stages of the impeller, in particular also in the rearmost stages. According to an embodiment of the invention, it is achieved in particular that thermolabile solids, such as, in particular, carbon dioxide or ice, do not already release all kinetic energy in the frontmost stages of the impeller, and/or do not sublime or melt there.

Instead, by way of the parameters according to the invention, the solids are merely imparted a base impulse which conveys the former into the engine. Subsequently, the solid material is entrained by the gas flow in the engine and thus conveyed also into the rearmost impeller stages. Therefore, according to an embodiment of the invention, the pressure of the carrier gas is 1 to 5 bar, preferably 2 to 4 bar. A particularly preferred pressure is 3 bar.

In order for the desired entrainment of the solids by way of the air flow in the impeller to be enabled without the solids prematurely impacting on the internal or external impeller wall, the exit direction of the nozzle (in the context of the invention, this term refers to the main exit direction) should reach into the impeller as far as possible, without this exit direction, or the imaginary axis thereof, respectively, contacting the walls of the impeller. For this purpose, it is provided according to an embodiment of the invention that the exit of the at least one nozzle is disposed at a radial spacing from the rotation axis of the engine which corresponds to 0.5 to 1.2 times, preferably to 0.5 to 1 times, the radius of the entry opening of the first compressor stage that is directed upstream. Thus, the exit in the radial direction is closer to the external impeller wall than to the rotation axis of the engine or of the impeller, respectively. According to an embodiment of the invention, the main exit direction of the nozzle is directed so as to be obliquely inward toward the rotation axis of the engine, and in relation to the latter encloses an angle of 10 to 30°, preferably of 12 to 25°, furthermore preferably of 16 to 19°.

The combination of these method parameters according to an embodiment of the invention allows effective cleaning of the impeller (core engine) of jet engines across the entire length thereof, in particular also in the stages which in the flow direction are rearward.

A compressor geometry which in the context of an embodiment of the invention is particularly preferred has a curved flow duct having a convex curvature of the flow duct that in the flow direction is at the front and is disposed so as to be radially inward, and a convex curvature of the flow duct that in the flow direction is disposed behind the former and so as to be radially outward. In the context of the invention, the term the convex curvature that in the flow direction is at the front and is disposed so as to be radially inward refers to an inward curvature of the flow duct in the direction of the rotation axis of the jet engine, and the term the convex curvature that in the flow direction is disposed behind the former and so as to be radially outward refers to an outward curvature of the flow duct. In a variant of the method according to an embodiment of the invention that is advantageous for this particularly preferred compressor geometry, the main exit direction of the at least one nozzle in relation to the rotation axis of the engine may preferably enclose an angle which is between $\beta$ and $\alpha$; wherein $\beta$ is the angle between the rotation axis of the engine and a first straight line which runs as a tangent on that convex curvature of the flow duct of the compressor that in the flow direction is at the front and is disposed so as to be radially inward, and on that convex curvature of the flow duct that in the flow direction is disposed behind the former and so as to be radially outward; and wherein $\alpha$ is the angle between the rotation axis of the engine and a second straight line which runs as a tangent on that periphery of the inlet of the compressor (impeller) that is disposed so as to be radially outward, and on that convex curvature of the flow duct that in the flow direction is disposed behind the former and so as to be radially inward. Furthermore, the exit of the at least one nozzle may preferably be disposed at a radial spacing from the rotation axis of the engine which lies between the radial spacings of the intersection points of the first and the second straight line with that radial plane in which the exit of the at least one nozzle is disposed. In the context of the invention, the term radial plane refers to a plane which is disposed so as to be perpendicular to the rotation axis.

According to an embodiment of the invention, the solids are preferably selected from the group composed of solid carbon dioxide and water ice. Solid carbon dioxide is particularly preferable. Carbon dioxide and/or water ice may be particularly preferably used in the form of pellets. The use of water ice as comminuted ice (so-called crushed ice) is likewise possible.

Pellets may be produced from liquid $CO_2$ in a so-called pelletizer and can be readily stored. It may be provided that a supply installation with the aid of the carrier gas conveys pellets which have already been prefabricated to the nozzle installation. However, it is also possible that the supply installation has a device for producing solid carbon dioxide pellets or solid carbon dioxide snow, respectively, from liquid carbon dioxide, the former conveying the latter by way of the carrier gas to the nozzle installation. In both cases, the solid carbon dioxide exits from the nozzles of the nozzle installation, reaching the engine to be cleaned. The technical basis for producing $CO_2$ pellets is described in the US armed forces document "Carbon Dioxide Blasting Operations". For example, pellets are obtained in a pelletizer or the like by compressing solid $CO_2$ (flakes, for example). The production of ice pellets (water ice) is known to the person skilled in the art and at this point does not require further explanation.

In one variant of the method according to an embodiment of the invention, the cleaning medium can have solid carbon dioxide and water ice in a ratio by mass of 5:1 to 1:5, preferably of 1:2 to 2:1. In principle, it is indeed already known (WO 2012/123098 A1) to provide a mixture of pellets from carbon dioxide and ice as a solid blasting means for cleaning surfaces. However, it has been demonstrated that this mixture may be employed in a particularly advantageous manner for cleaning jet engines, since the majority of the solid carbon dioxide already sublimes in the front region of the compressor, cleaning the latter by the kinetic energy of the collision, on the one hand, and by thermal effects, on the other. By virtue of the tension between heat and cold that is initiated by the carbon dioxide, contamination is released from the surfaces of the engine components. The ice which is added to the mixture according to an embodiment of the invention has higher hardness and longer durability than solid carbon dioxide. On account thereof, said ice improves the mechanical cleaning effect by way of the kinetic energy of the impact, on the one hand, and is better capable of penetrating the compressor as a whole up to the rear stages, still developing a cleaning effect even there. On the one hand, the mixture employed according to an embodiment of the invention has the effect of largely complete and uniform cleaning of all stages of the compressor, and, on the other hand, introduces only comparatively small amounts of water into the engine. Typically, according to an embodiment of the invention, this water being introduced is largely transported out of the engine by the carrier gas (preferably air) employed, or by the air flow flowing through the engine in the case of dry cranking.

The mean size of the pellets used is preferably in the range of 1 to 10 mm, may preferably be approx. 3 mm. If and when elongate pellets are used, the length thereof may be 3 to 6 mm, for example, the dimension transverse to the longitudinal extent being approx. 3 mm, for example.

Preferably, the solids are introduced at a mass flow rate of 100 to 2000 kg/h, furthermore preferably of 200 to 1500 kg/h, furthermore preferably of 350 to 2000 kg/h, furthermore preferably of 400 to 2000 kg/h, furthermore preferably of 350 to 1200 kg/h, furthermore preferably of 400 to 1200 kg/h, furthermore preferably of 100 to 600 kg/h, furthermore preferably of 200 to 500 kg/h, furthermore preferably of 350 to 450 kg/h. The duration of the cleaning procedure (pure blasting time without intervals) is preferably 1 to 15 min, furthermore preferably 2 to 10 min, furthermore preferably 4 to 8 min. Thus, during one cleaning procedure 1.5 to 200 kg, preferably 35 to 200 kg, furthermore preferably 40 to 200 kg, furthermore preferably 40 to 120 kg, furthermore preferably 1.5 to 50 kg, furthermore preferably 3 to 35 kg, furthermore preferably 7 to 25 kg of solids may be introduced into the engine, for example.

Preferably, the nozzle or the nozzles, respectively, is/are flat-jet nozzles, for example flat-jet nozzles, having an opening angle of 1°.

Dry cranking or rotating of the jet engine, respectively, during the cleaning procedure is preferably performed at a fan revolution speed of 50 to 500 $min^{-1}$, preferably of 100 to 300 $min^{-1}$, furthermore preferably of 120 to 250 $min^{-1}$. A fan revolution speed between 150 and 250 $min^{-1}$ is particularly preferable. Cleaning may also take place when the engine is idling. The revolution speed then is preferably 500 to 1500 $min^{-1}$.

An embodiment of the invention provides a nozzle installation having at least one nozzle which is configured for introducing cleaning media containing solids into a jet engine, which has means for the rotationally fixed connection to the shaft of the turbofan of a jet engine, and which has a swivel coupling to which a line connection is connectable.

In a first variant of an embodiment of the invention it is provided that the curvatures contained in the lines for guiding the cleaning medium from the swivel coupling to the nozzles are configured such that solid carbon dioxide may follow the flow without hindrance, without sublimating on the pipe walls by virtue of excessively tight curvature radii.

In a second design of an embodiment of the invention, which is either independent or preferably is to be combined with the first variant of an embodiment of the invention, it is provided that the connection of the nozzle-side outlet of the swivel coupling to the inlet of the at least one nozzle is performed by means of a flexible hose.

A basic concept which interlinks both variants of an embodiment of the invention lies in that the lines for the cleaning medium, from the swivel coupling to the exit of the nozzle, have transition angles or curvature angles, respectively, which are as smooth as possible and not excessively large, so as to enable conveying of the solids by means of the carrier gas that is as friction-free as possible. In the case of the second variant, the use of preferably detachable hoses, by way of the flexibility of the latter, enables guiding of the solids that is curved in an adequately smooth manner. On the other hand, the hoses ensure that the nozzle installation is adequately small and not too cumbersome for storage and transportation; in particular, the hoses may preferably be detached for storage and transportation, and may be transported or kept separately.

A line connection connects the nozzle installation to a supply installation; this supply installation makes available the cleaning medium (for example in tanks) and may be provided with operation and drive installations, pumps, energy storage units, or the like. Said supply installation is preferably configured as a mobile unit, in particular as a unit on wheels.

The nozzle installation has one or a plurality of nozzles. It is particularly preferable for the nozzle installation to have at least two nozzles.

By way of the rotationally fixed connection to the shaft, the nozzle installation may conjointly rotate in the case of dry cranking, that is in the case of the engine being slowly rotated without kerosene being injected.

The term the swivel coupling between the nozzle installation and the line connection is to be understood in a functional manner; it refers to any installation which is suitable for producing an adequately stable and preferably pressure tight and sealed connection between the stationary part of the line connection and the nozzle installation which conjointly rotates with the fan. The purpose of the swivel coupling is to guide the cleaning medium from the stationary supply installation into the conjointly rotating nozzle installation, allowing said cleaning medium to then exit from the nozzles.

The swivel coupling is preferably located in the forward region of the nozzle installation, that is to say in that region which in the fitted state points upstream, that is to say away from the inlet of the jet engine. Accordingly, the exit opening of the nozzles is provided in the axial end region of the nozzle installation that points away from said forward region, that is to say in that end region that in the fitted state is downstream. This arrangement enables the nozzles during fitting to the shaft of the fan of a turbofan engine to either be pushed through the intermediate spaces of the blades such that said nozzles are disposed directly in front of the first compressor stage, or else at least to be aligned in a targeted manner such that said nozzles spray through the intermediate spaces of the blades of the turbofan directly onto the first compressor stage.

The nozzle-side outlet of the swivel coupling is preferably diametrically opposite the inlet. Preferably, the inlet points in the axial direction and upstream, that is to say toward that direction from which the inflow to the engine takes place in the fitted state of the nozzle installation to an engine. The diametrically opposed outlet is likewise performed downstream in the axial direction. In this manner, the cleaning medium within the swivel coupling is not subject to any or is subject to only a minor variation of the flow direction such that no undesirable friction of the solids arises by way of curvatures or of excessively tight curvatures of the lines, respectively.

In the case of the nozzle installation according to an embodiment of the invention, the nozzle or the nozzles are typically disposed in the radially outward region, while the swivel coupling is usually disposed in the rotation axis. In order to enable guiding of the cleaning medium through lines or flexible hoses, respectively, having minor curvatures, it is advantageous for the swivel coupling which usually constitutes that axial end of the nozzle installation that is directed upstream to have a sufficiently large axial spacing from the means for the rotationally fixed connection to the shaft of the turbofan, which usually constitute that end of the nozzle installation according to an embodiment of the invention that is directed downstream, said spacing permitting or facilitating, respectively, guiding of the lines from the swivel coupling to the nozzles at adequately large curvature radii. For example, the axial spacing of the swivel coupling from said means for the rotationally fixed connection to the shaft of the turbofan may preferably be 0.2 to 2 m, furthermore preferably 0.5 to 2 m, furthermore preferably 0.75 to 1.25 m. Furthermore, guiding of the cleaning medium from the inlet of the at least one nozzle to the nozzle exit may be configured so as to be substantially in a straight line. There is thus no deflection of the cleaning medium performed between the entry and exit within the actual nozzles.

It may be provided that the nozzle installation is fastened to the turbofan such that the nozzles of the former point between the blades of the turbofan. On account thereof, targeted cleaning of the compressor stages and, subsequent thereto, of the combustion chamber or of the turbine stages, respectively, is achieved. The nozzles which in the case of dry cranking are conjointly rotated here uniformly sweep the first compressor stage across the entire circumference. The cleaning medium here is not subjected to being compromised by the turbofan which in the flow direction is disposed therebefore, and the spray direction of the cleaning medium may in this way be adapted to the angle of attack of the blades of the first compressor stage.

The mass distribution of the nozzle installation is preferably rotationally symmetrical about the rotation axis thereof. In this manner, no significant additional imbalance is introduced when the nozzle installation is conjointly rotated. For this purpose, the swivel coupling in the fitted state preferably sits in a substantially centric manner on the rotation axis of the device according to an embodiment of the invention. The nozzle installation preferably has at least two or more nozzles which are preferably distributed so as to be rotationally symmetrical about the rotation axis. The nozzles are preferably configured as flat-jet nozzles which preferably may have an opening angle of 1°, for example.

The radial spacing of the nozzle exit from the rotation axis of the engine, and thus also from the nozzle installation, according to an embodiment of the invention may be 200 to 800 mm, furthermore preferably 400 to 750 mm, furthermore preferably 600 to 700 mm, furthermore preferably 200 to 400 mm, furthermore preferably 230 to 300 mm, furthermore preferably 260 to 280 mm, for example. These values depend on the engine to be cleaned and may vary accordingly. The preferred spacing of 260 to 280 mm is suitable for cleaning the core engine of a CF6-50 engine, for example. The preferred spacing of 600 to 700 mm is suitable for cleaning the core engine of a CF6-80 engine, for example. In the case of a fitted nozzle installation, the nozzle exit is then located in the region of the radially outward periphery of the entry to the impeller.

The plane of the jet, or the main exit direction of the nozzle(s), respectively, is preferably directed so as to be obliquely inward toward the rotation axis of the engine, and in relation to this axis encloses an angle of 10 to 30°, preferably of 12 to 25°, furthermore preferably of 16 to 19°. The values mentioned may vary, depending on the engine to be cleaned, and should be chosen such that the main exit direction of the nozzle (or the imaginary extension thereof) protrudes as far as possible into the impeller without contacting internal or external walls of the impeller.

In the case of one preferred embodiment, the plane of the jet, or the main exit direction of the nozzle(s), respectively, in relation to the rotation axis of the engine may preferably enclose an angle which is between $\beta$ and $\alpha$; wherein $\beta$ is the angle between the rotation axis of the engine and a first straight line which runs as a tangent on that convex curvature of the flow duct of the compressor that in the flow direction is at the front and is disposed so as to be radially inward, and on that convex curvature of the flow duct that in the flow direction is disposed behind the former and so as to be radially outward; and wherein $\alpha$ is the angle between the rotation axis of the engine and a second straight line which runs as a tangent on that periphery of the inlet of the compressor (impeller) that is disposed so as to be radially outward, and on that convex curvature of the flow duct that in the flow direction is disposed behind the former and so as to be radially inward.

The means for the rotationally fixed connection to the shaft of the turbofan of the jet engine preferably comprise fastening means for fastening to the turbofan blades, such as, for example, suitably configured hooks by way of which the nozzle installation may be hooked to the rear edges (those edges that lie downstream) of the blades of the turbofan.

For fixing in a rotationally fixed manner to the shaft of the turbofan, the nozzle installation may have an installation for placing in a substantially form-fitting manner onto the shaft hub of the fan. Specifically, turbofan engines, on that end of the shaft of the turbofan that lies upstream, typically have a conically curved hub which is intended to improve the inflow behavior of the air. The respective means for the rotationally fixed connection may be placed onto this hub. "In a substantially form-fitting manner" in this context means that the shape of the shaft hub is utilized for controlled positioning of the nozzle installation and for fixing in the desired position. It does not mean that the entire surface area of the shaft hub has to be enclosed in a form-fitting manner.

For example, the installation may have one or a plurality of annular parts by way of which the former may be placed onto the shaft hub. In the case of a plurality of annular parts, the latter have dissimilar diameters which are adapted to the diameter of the shaft hub in the respective regions. For example, two axially spaced-apart rings having dissimilar diameters, by way of which the nozzle installation is positioned and centered on the shaft hub, may be provided.

For further fixing, tensioning ropes may preferably be provided. For example, the nozzle installation by means of the annular parts may be centered on the shaft hub of the fan, and then be tensioned using tensioning ropes which are fixed to the rear edge of the turbofan blades. According to an embodiment of the invention, spring installations for pretensioning the tensioning ropes may be provided, in order for the nozzle installation to be urged against the shaft hub at a defined force. The tensioning ropes are preferably fastened to the turbofan blades (for example by means of hooks), preferably to the rear edge thereof.

A supply installation for the cleaning medium preferably has storage tanks for the composite parts of the cleaning medium, and at least one pump for the pressurized application of the nozzle installation using the cleaning medium. A carrier gas, preferably air, is employed. The carrier gas may be pretreated, it may be dried, for example, in order for said carrier gas to be able to absorb and discharge as large a proportion as possible of the water being introduced into the engine. It may be provided for the carrier gas to be cooled, in order for ice pellets and/or carbon dioxide pellets in the carrier gas flow to be as resilient as possible. Alternatively, however, it is also possible for the carrier gas flow to be heated, for example to a temperature of approx. 80° C. In the case of carbon dioxide pellets, for example, this at first appears to be absurd, since the resilience of the pellets is reduced. However, an embodiment of the invention has identified that the warm carrier gas flow supplies thermal energy to the interior of the engine, said thermal energy equalizing cooling by the cleaning medium. This prevents that the solid carbon dioxide by way of excessive cooling can only impart an inadequate cleaning effect (by virtue of the excessively low temperature differential). Also, it may be prevented in this way that water, which in the case of water ice being used as the cleaning medium remains in the interior of the engine, freezes solid. Since the carrier gas acts on the cool pellets only over a very short period of time before the latter are able to impart the cleaning effect thereof, the influence of the heated carrier gas on the pellets is insignificant or barely significant.

An embodiment of the invention provides an assembly of a jet engine and of a nozzle installation. The assembly is characterized in that the nozzle installation is disposed such that the nozzle(s) thereof is/are directed toward the inlet of the jet engine. The plane of the jet, or the main exit direction of the nozzle(s), respectively, is preferably directed so as to be obliquely inward toward the rotation axis of the engine and in relation to this axis encloses an angle of 10 to 30°, preferably of 12 to 25°, furthermore preferably of 16 to 19°. Preferably, the exit of the at least one nozzle is disposed at a radial spacing from the rotation axis of the engine which corresponds to 0.5 to 1.2 times, preferably to 0.5 to 1 times, the radius of the entry opening of the first compressor stage that is directed upstream. Thus, the exit in the radial direction is closer to the external impeller wall than to the rotation axis of the engine or of the impeller, respectively.

In one preferred embodiment, the main exit direction of the nozzle(s) in relation to the rotation axis of the engine may enclose an angle which is between $\beta$ and $\alpha$; wherein $\beta$ is the angle between the rotation axis of the engine and a first straight line which runs as a tangent on that convex curvature of the flow duct of the compressor that in the flow direction is at the front and is disposed so as to be radially inward, and on that convex curvature of the flow duct that in the flow direction is disposed behind the former and so as to be radially outward; and wherein $\alpha$ is the angle between the rotation axis of the engine and a second straight line which runs as a tangent on that periphery of the inlet of the compressor (impeller) that is disposed so as to be radially outward, and on that convex curvature of the flow duct that in the flow direction is disposed behind the former and so as to be radially inward. Furthermore, the exit of the at least one nozzle may be disposed at a radial spacing from the rotation axis of the engine which lies between the radial spacings of the intersection points of the first and the second straight line with that radial plane in which the exit of the at least one nozzle is disposed.

It may preferably be provided that the nozzle installation is connected in rotationally fixed manner to the shaft of the fan of the jet engine; that the rotation axes of the fan of the jet engine and of the nozzle installation are disposed so as to be substantially concentric; that the nozzles of the nozzle installation have a radial spacing from the common rotation axis of the jet engine and of the device that corresponds to 0.5 to 1.2 times, preferably to 0.5 to 1 times, the radius of the first compressor stage; and that the exit openings of the nozzles in the axial direction are disposed behind the plane of the turbofan, and/or the nozzles are disposed in the intermediate spaces of the blades of the turbofan and/or are directed toward intermediate spaces of the blades of the turbofan such that the nozzle jets may pass through the plane of the turbofan substantially without hindrance.

Figure 2:
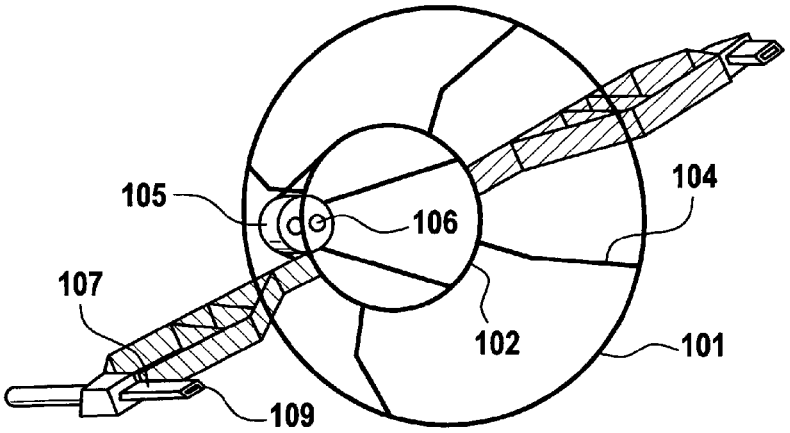
FIG. 2 shows a second view of a nozzle installation according to an embodiment of the invention.

FIG. 1 shows a first view of a nozzle installation according to an embodiment of the invention and FIG. 2 shows a second view of a nozzle installation according to an embodiment of the invention. The nozzle installation has two annular elements 101, 102, with the aid of which the nozzle installation is placed onto a shaft hub of the turbofan of a jet engine. In the placed state, the annular elements 101, 102 enclose the shaft hub in a substantially form-fitting manner. For the details of the connection of the nozzle installation to a shaft hub, reference is made to WO 2009/132847 A1, the disclosure of which by way of reference is also rendered the subject matter of the present application. The two annular elements 101, 102 are interconnected by radial stays 104. A swivel coupling which in its entirety is referenced with 105 and which has an inlet 110 is disposed on that tip of the nozzle installation that points upstream (in relation to the flow direction of the engine). Alternatively to the branch-out to the pressure connectors 106, the swivel coupling 105 may be configured so as to be separate and may be connected to the former by a short piece of hose, for example, the flexibility of the latter aiding in equalizing potential axial deviations when fitting. Two pressure connectors 106 extend from this swivel coupling 105, so as to lead axially downstream. Two pressure hoses 108 may be connected to the pressure connectors 106, the respective other end of which is connected to the entry of the flat-jet nozzles 107 (for the sake of clarity, only one pressure hose 108 is illustrated in FIG. 1). The length and the flexibility of these pressure hoses 108 is dimensioned such that the latter in the fitted state in terms of the curvatures are configured such that the latter permit conveying of the jet medium without interference. By virtue of the large curvature radii, solids and in particular pellets may be transported in a low-friction manner from the entry of the swivel coupling 105 to the nozzle exit 109 of the flat-jet nozzles 107. The two flat-jet nozzles 107 are fed with cleaning media in this way.

The axial spacing of the swivel coupling 105 from the exit openings 109 of the nozzles 107 in the exemplary embodiment is approx. 1.2 m. This spacing is adequate for the pressure hoses 108 to be able to connect the inlets of the nozzles 107 to the outlets 106 of the swivel coupling 105, without these pressure hoses 108 being excessively curved. The radial spacing of the nozzle exit 109 from the rotation axis in the exemplary embodiment is approx. 270 mm. Said spacing is adapted to cleaning a CF6-50 engine. The main exit direction of the nozzles 107 (this corresponding substantially to the longitudinal axis thereof) in relation to the rotation axis of the nozzle installation encloses an angle of 18°. Fastening of the nozzle installation to the shaft hub of a turbofan is performed by means of tensioning ropes, such as is described in detail in WO 2009/132847 A1.

In order for a jet engine to be cleaned, the nozzle installation is placed onto the shaft hub of the turbofan and fixed to the blades of the turbofan. The engine is set in rotation (dry cranking). The flat-jet nozzles 107 are fed via the swivel coupling 105 and the pressure hoses 108 with a cleaning medium from a supply installation (not illustrated). This cleaning medium sweeps the inlet of the first compressor stage across the entire circumference thereof, thus performing cleaning.

Figure 3:
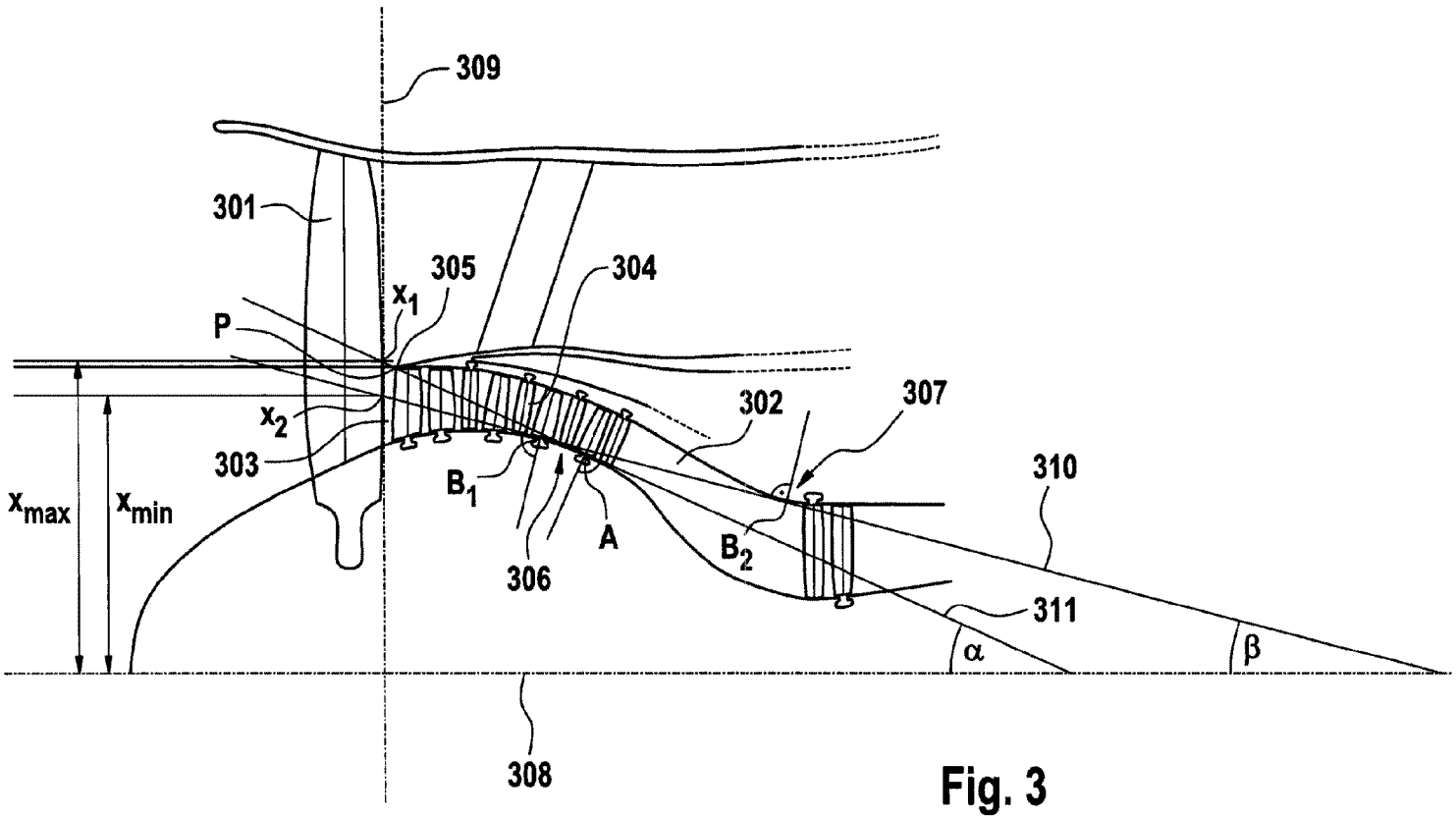
FIG. 3 shows a view of a compressor geometry according to an embodiment of the invention.

FIG. 3 shows the schematic fragment of an engine having a particularly preferred compressor geometry. A turbofan blade 301 and the inlet 303 of the compressor 304, which is disposed downstream of the former, are illustrated in relation to the rotation axis 308 of the engine. The inlet 303 has a periphery 305 which is disposed so as to be radially outward. A convex curvature 306 of the flow duct 302 of the compressor, which is disposed so as to be radially inward, is disposed in the flow direction behind the periphery 305. This here is an inward curvature in the direction of the rotation axis 308 of the engine. A convex curvature 307 of the flow duct 302, which is disposed so as to be radially outward, in the flow direction is behind the curvature 306. The main exit direction of the nozzle(s) (not shown in FIG. 3) in relation to the rotation axis 308 of the engine may preferably enclose an angle which is between the angles $\beta$ and $\alpha$, wherein $\beta$ is the angle between the rotation axis 308 of the engine and a first straight line 310 which runs as a tangent on that convex curvature 306 (at point $B_1$) of the flow duct of the compressor that in the flow direction is at the front and is disposed so as to be radially inward, and on that convex curvature 307 (at point $B_2$) of the flow duct 302 that in the flow direction is disposed behind the former and so as to be radially outward; and wherein $\alpha$ is the angle between the rotation axis 308 of the engine and a second straight line 311 which runs as a tangent on that periphery 305 of the inlet 303 of the compressor 304 (at point P) that is disposed so as to be radially outward, and on that convex curvature 306 (at point A) of the flow duct that in the flow direction is disposed behind the former and so as to be radially inward. Furthermore, the exit of a nozzle (not shown) may be disposed at a radial spacing from the rotation axis 308 of the engine which lies between the radial spacings ($x_{min}$, $x_{max}$) of the intersection points ($x_2$, $x_1$) of the first and the second straight line with that radial plane 309 in which the exit of the nozzle (not shown in FIG. 3) is disposed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A nozzle installation comprising:

at least one nozzle configured for introducing a cleaning medium containing solids into a jet engine, a swivel coupling to which a line connection is connectable, the swivel coupling having an inlet and a nozzle-side outlet which is diametrically opposite the inlet such that the cleaning medium will flow straight through the swivel coupling during a cleaning operation, and a flexible hose which forms a connection of the nozzle-side outlet of the swivel coupling to an inlet of the at least one nozzle, wherein the nozzle installation is configured to have a rotationally fixed connection to a shaft of a turbofan of the jet engine such that the swivel coupling is axially spaced apart from the rotationally fixed connection by 0.2 to 2 m.

2. The nozzle installation of claim 1, wherein guiding of the cleaning medium from the inlet of the at least one nozzle to an exit of the at least one nozzle is configured so as to be substantially in a straight line.

3. The nozzle installation of claim 1, wherein the nozzle installation is configured for introducing the cleaning medium into compressor stages of the jet engine.

4. The nozzle installation of claim 1, wherein the nozzle installation has flat-jet nozzles.

5. The nozzle installation of claim 1, wherein a radial spacing of an exit of the at least one nozzle from a rotation axis of the swivel coupling is 200 to 800 mm.

6. The nozzle installation of claim 1, wherein a main exit direction of the at least one nozzle is obliquely inward towards the axis of rotation of the engine and in relation to the rotation axis of the jet engine encloses an angle which is 10 to 30°.

7. The nozzle installation of claim 1, wherein a compressor of the jet engine includes a flow duct having a first convex curvature at a radially-inward side of the flow duct and a second convex curvature at a radially-outward side of the flow duct, the first convex curvature being disposed in front of the second convex curvature in a flow direction of the flow duct;

wherein a main exit direction of the at least one nozzle in relation to a rotation axis of the swivel coupling encloses an angle which is between $\beta$ and $\alpha$;

wherein $\beta$ is the angle between the rotation axis of the swivel coupling and a first straight line which runs as a tangent on the first and second convex curvatures; and wherein $\alpha$ is the angle between the rotation axis of the engine and a second straight line which runs as a tangent on a periphery of an inlet of the compressor at the radially-outward side of the flow duct, and on the first convex curvature which is disposed behind the inlet in the flow direction of the flow duct.

8. The nozzle installation according to claim 7, wherein an exit of the at least one nozzle is disposed at a radial spacing from the rotation axis of the swivel coupling which lies between radial spacings of intersection points of the first and the second straight lines with a radial plane at which the exit of the at least one nozzle is disposed.

9. The nozzle installation according to claim 1, wherein the swivel coupling is axially spaced apart from the rotationally fixed connection by 0.5 to 2 m.

10. The nozzle installation according to claim 9, wherein the swivel coupling is axially spaced apart from the rotationally fixed connection by 0.75 to 1.25 m.

11. An assembly comprising:

a jet engine; and the nozzle installation of claim 1, wherein the nozzle installation is disposed such that the at least one nozzle thereof is directed toward an inlet of the jet engine such that the cleaning medium can make its way into the jet engine.

12. The assembly of claim 11, wherein a main exit direction of the at least one nozzle in relation to the rotation axis of the jet engine encloses an angle of 10 to 30°.

13. The assembly of claim 11, wherein an exit of the at least one nozzle is disposed at a radial spacing from the rotation axis of the engine which corresponds to 0.5 to 1.2 times the radius of an entry opening of a first compressor stage that is directed upstream.

14. The assembly of claim 11, wherein a compressor of the jet engine includes a flow duct having a first convex curvature at a radially-inward side of the flow duct and a second convex curvature at a radially-outward side of the flow duct, the first convex curvature being disposed in front of the second curvature in a flow direction of the flow duct;

wherein a main exit direction of the at least one nozzle in relation to the rotation axis of the jet engine encloses an angle which is between $\beta$ and $\alpha$;

wherein $\beta$ is the angle between the rotation axis of the jet engine and a first straight line which runs as a tangent on the first and second convex curvatures;

wherein $\alpha$ is the angle between the rotation axis of the jet engine and a second straight line which runs as a tangent on a periphery of an inlet of the compressor at the radially-outward side of the flow duct, and on the first convex curvature which is disposed behind the inlet in the flow direction of the flow duct; and wherein the exit of the at least one nozzle is disposed at a radial spacing from the rotation axis of the engine which lies between radial spacings of intersection points of the first and the second straight lines with a radial plane at which the exit of the at least one nozzle is disposed.

15. The assembly of claim 11, wherein the nozzle installation is connected in a rotationally fixed manner to a shaft of a turbofan of the jet engine;

wherein rotation axes of the turbofan of the jet engine and of the nozzle installation are disposed so as to be substantially concentric;

wherein the at least one nozzle of the nozzle installation has a radial spacing from the common rotation axis of the jet engine and of the nozzle installation that corresponds to 0.5 to 1.2 times the radius of an entry opening of a first compressor stage; and wherein exit openings of the at least one nozzle in the axial direction are disposed behind the plane of the turbofan, and/or the at least one nozzle is disposed in intermediate spaces of blades of the turbofan and/or directed toward intermediate spaces of the blades of the turbofan such that a jet of the at least one nozzle may pass through the plane of the turbofan substantially without hindrance.

* * * * *